United States Patent [19]

Kahlke

[11] Patent Number: 4,984,775

[45] Date of Patent: Jan. 15, 1991

[54] CORNER CLAMP ASSEMBLY

[76] Inventor: Robert J. Kahlke, 2434 Alvarado Dr., Santa Clara, Calif. 95051

[21] Appl. No.: 331,708

[22] Filed: Mar. 31, 1989

[51] Int. Cl.[5] ..... B25B 1/20

[52] U.S. Cl. ..... 269/41; 269/2; 269/60; 269/71; 269/126; 269/155

[58] Field of Search ..... 269/1, 2, 41, 42, 45, 269/58, 60, 71, 126, 129, 152, 155, 244

[56] References Cited

U.S. PATENT DOCUMENTS

| | | | |
|---|---|---|---|
| 4,236,702 | 12/1980 | Koddie | 269/41 |
| 4,338,712 | 7/1982 | Dearman | 269/41 |
| 4,377,959 | 3/1983 | DeCarolis | 269/41 |
| 4,385,755 | 5/1983 | Mawer | 269/155 |

OTHER PUBLICATIONS

1989 Catalog of M & M Distributors, Rt. 522, P.O. Box 96, Tennet, N.J., 07763.

*Primary Examiner*—J. J. Hartman

*Attorney, Agent, or Firm*—Lyon & Lyon

[57] ABSTRACT

A woodworking corner clamp assembly having two screw clamp assemblies, each clamp assembly being oriented perpendicular to one leg of an L-shaped frame. Each clamp is also capable of longitudinal sliding movement along one leg of the L-shaped frame. The longitudinal position of each clamp along the respective leg of the L-shaped frame is controlled by the rotation of a threaded rod which passes through a longitudinal slot located in the leg of the frame and through a portion of the base of the clamp member, such that rotation of the threaded rod causes the clamp to be driven longitudinally along the length of the frame.

6 Claims, 4 Drawing Sheets

FIG. 5
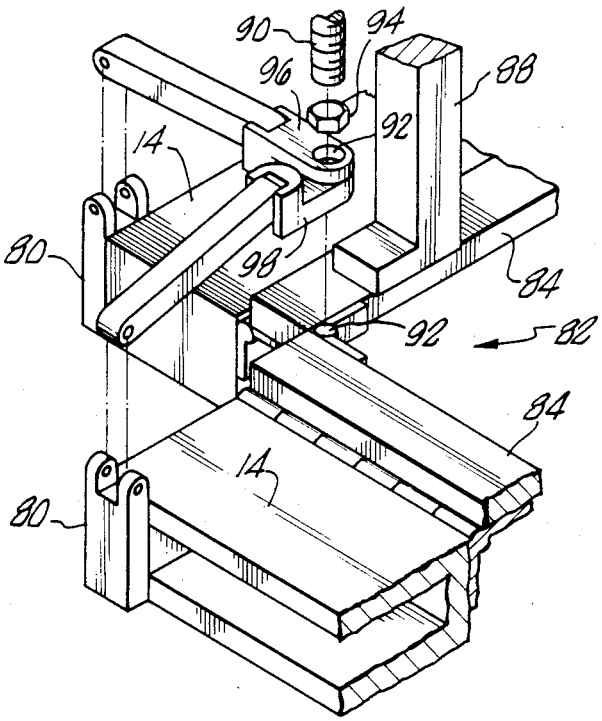
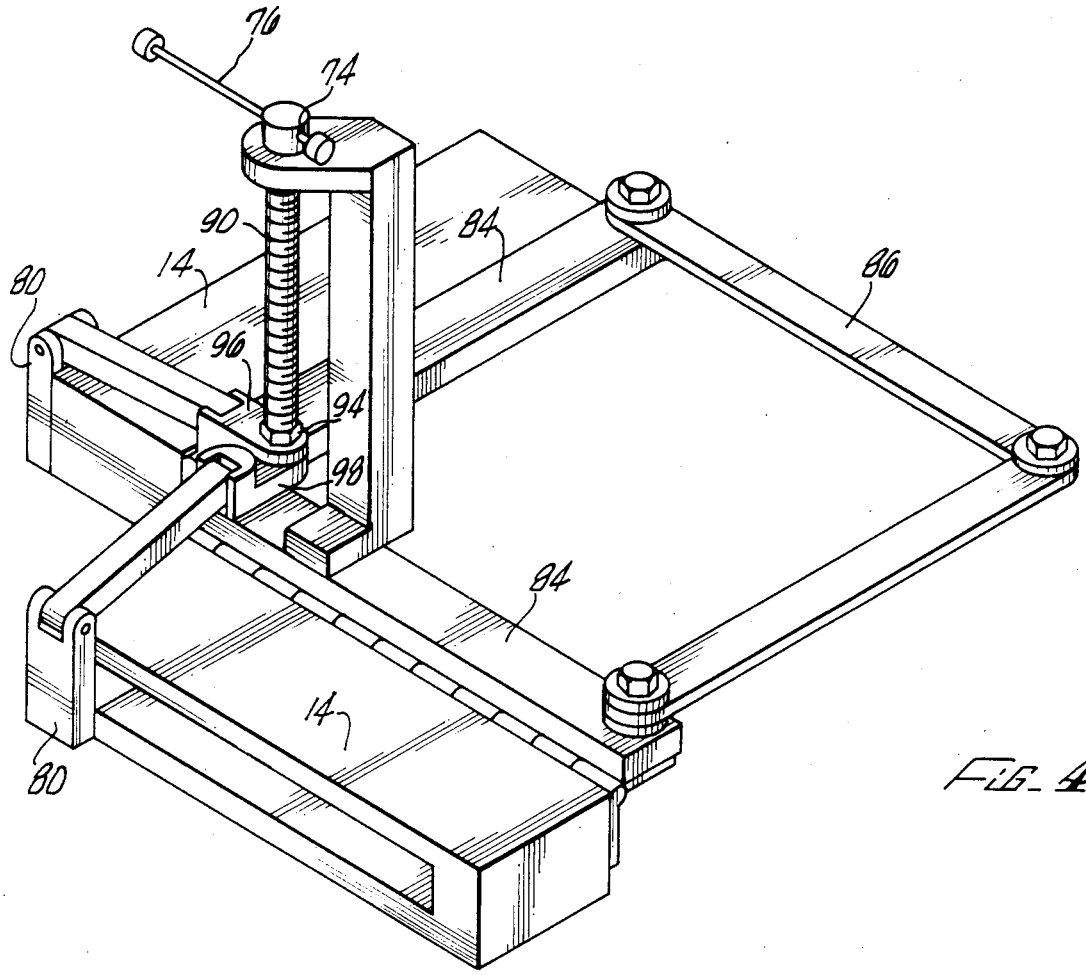
FIG. 4

CORNER CLAMP ASSEMBLY

BACKGROUND OF THE INVENTION

The field of the present invention relates to a corner clamp assembly used in connection with the cutting and connecting together of the bevel corners of picture windows and other woodworkings.

In the field of woodworking, it often becomes necessary to clamp two pieces of wood to be glued, nailed, screwed, or otherwise fastened together in order to obtain the accuracy and precision in orientation necessary for quality construction and craftsmanship. There are circumstances when the pieces to be joined must be oriented in parallel, at right angles, or at other predetermined angles. In order to accomplish this, clamp assemblies must be used which can clamp more than one piece of wood at the appropriate orientations. It is well-known in the art to use clamp assemblies which hold two pieces of wood for joining at right angles, but the prior art suffers from both a lack of adjustability at angles other than right angles and a lack of relative adjustability between the individual clamps themselves. Therefore, there exists a need in the art for corner clamps which have a wide range of relative adjustability between the individual clamps themselves.

SUMMARY OF THE INVENTION

The present invention is directed to a Woodworking corner clamp assembly having two screw clamp assemblies, each clamp assembly being oriented perpendicular to on leg of an L-shaped frame. This basic structure permits the use of a plurality of mechanisms to provide degrees of freedom to the device.

In a first aspect of the present invention, each clamp may be capable of longitudinal sliding adjustment along one leg of the L-shaped frame. Longitudinal movement of each clamp along the respective leg of the L-shaped frame may be controlled by the rotation of a threaded rod which passes through a longitudinal slot located in the leg of the frame and through a portion of the base of the clamp member.

In a second aspect of the invention, the clamps may be positionable at other than a 90° angle. A hinge where the two legs forming the L-shaped frame join along with a four-legged bracket bolted to the ends of the legs of the L-shaped frame enable the L-shaped assembly to be configured and secured at angles other than a right angle.

In a third aspect of the invention, a threaded rod positioned immediately above the intersection of the two legs forming the L-shaped frame can be used in conjunction with pivotable legs to allow both of the legs to be vertically tilted at an angle out of the plane of the L, thus allowing complex-angled wooden pieces to be joined.

In a fourth aspect of the invention, the legs of the L-shaped frame of the third embodiment may be pivotable as in the second embodiment, thus allowing several degrees of freedom of movement of the clamps to allow very complex-angled pieces to be joined.

It is, therefore, an object of the present invention to provide a wide range of adjustability in securely holding and orienting two wooden pieces to be joined at right angles and other complex orientations. Other and further objects and advantages will appear hereinafter.

BRIEF DESCRIPTION OF THE DRAWINGS

In the drawings wherein similar reference characters denote similar elements throughout the several views:

FIG. 4 is a perspective view of a fourth embodiment of the present invention;

FIG. 5 is an exploded perspective view of the tilting mechanism of the fourth embodiment of the present invention.

DESCRIPTION OF THE PREFERRED EMBODIMENTS

Figure 1:
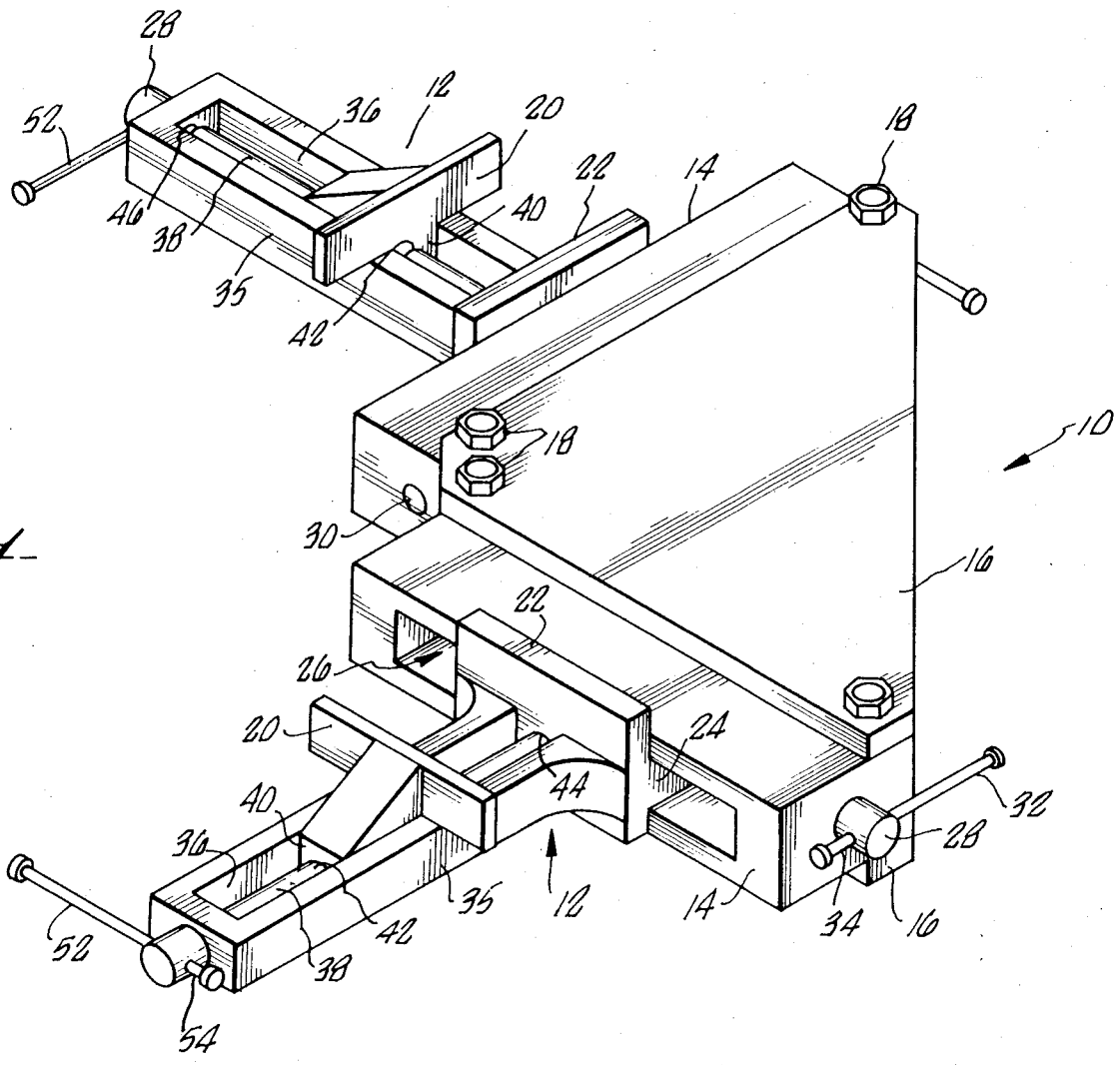
FIG. 1 is a perspective view of the preferred embodiment of the present invention.

Turning in detail to the drawings, FIG. 1 illustrates the corner clamp assembly which comprises an L-shaped frame, generally designated 10, and two clamping means, generally designated 12. More particularly, the L-shaped frame 10 comprises two legs 14 secured to two triangular base plates 16 by four nut and bolt assemblies 18. The clamping means may be conveniently identical. Each clamping means 12 comprises two clamping jaw members 20, 22. The jaw member 22 has a protrusion 24 which slidably fits within a longitudinal slot 26 located within each leg 14. Each protrusion 24 has a threaded hole (not shown) through which a threaded rod 28 passes. Each threaded rod 28 also passes completely through an unthreaded hole (not shown) located in one end of each leg 14. The other end of each threaded rod 28 passes either completely or partially through a hole 30 in the other end of each leg 14. Each threaded rod 28 is secured within a leg 14 by means well known in the art (such as a cotter pin or spring clip, not shown) at either end of the associated leg 14. A handle 32 passes through a hole 34 located in the enlarged end of each threaded rod 28 in order to rotate the threaded rod 28 and thereby cause sliding movement of either clamping means 12 in a longitudinal direction along the length of the leg 14 and also retain the clamping means 12 once positioned.

Each jaw member 22 also extends perpendicularly outwardly away from the associated leg 14 to define a frame 35. This frame 35 contains a lengthwise longitudinal slot 36 which houses another threaded rod 38 and the base 40 of jaw member 20. Each threaded rod 38 extends completely or partially through a smooth bore hole 44 located within the protrusion 24 of the jaw member 22, passes through a threaded hole 42 located within base 40 and extends completely through a smooth bore hole 46 in the outer end of the jaw member 22. As shown in the second embodiment in FIG. 2, the first embodiment includes nut 48 securing each threaded rod 38 and each clamping means 12 to each leg 14 via a plate 50. A handle 52 passes through a hole 54 in the end of each threaded rod 38 in order to rotate the threaded rod 38 and thereby cause slidable movement of the jaw member 20 in a longitudinal direction along the length of the jaw member 22, enabling the jaw members 20, 22 to grip different widths of wood parts to be joined.

Figure 2:
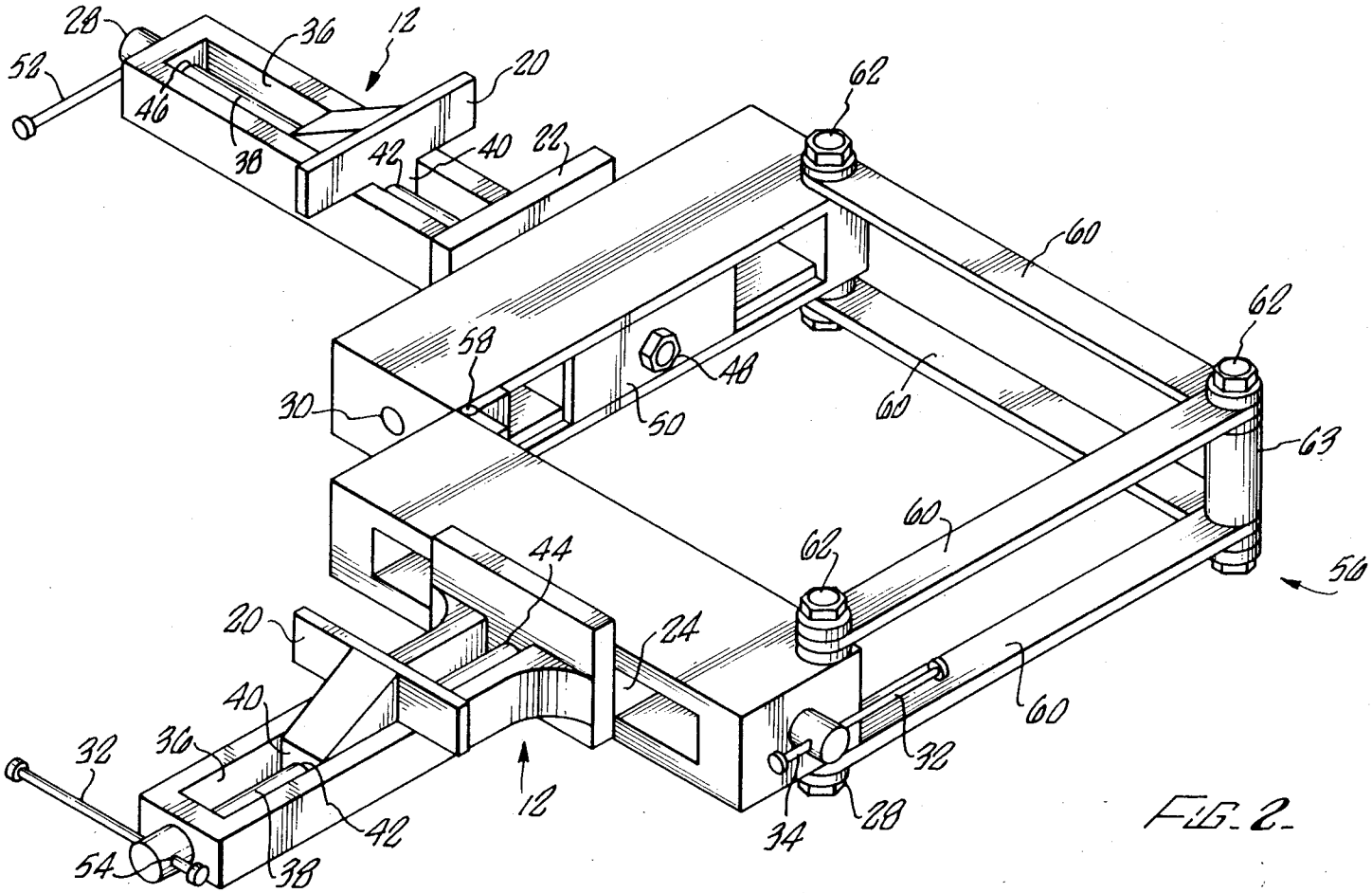
FIG. 2 is a perspective view of a second embodiment of the present invention.

In a second embodiment of the present invention, as shown in FIG. 2., the base plates 16 are replaced by a pivotable bracket generally designated 56; and the legs 14 of the L-shaped frame 10 are pivotable about a hinge 58. The outer end of each leg 14 is pivotably connected to the ends of two link members 60 of the bracket 56 by nut and bolt assemblies 62. The four members 60 of the bracket 56 are pivotally linked about a nut and bolt assembly 62 having a cylindrical spacer 63. The combination of the pivotable L-shaped frame 10 and the bracket 56 allows the legs of the L-shaped frame 10 to form angles between zero and 180 degrees, allowing a large degree of adjustability for holding the ends of wooden pieces together via clamping means 12. The nut and bolt assemblies 62, when tightened, securely fix the angle selected between the legs 14 of the L-shaped frame 10.

Figure 3:
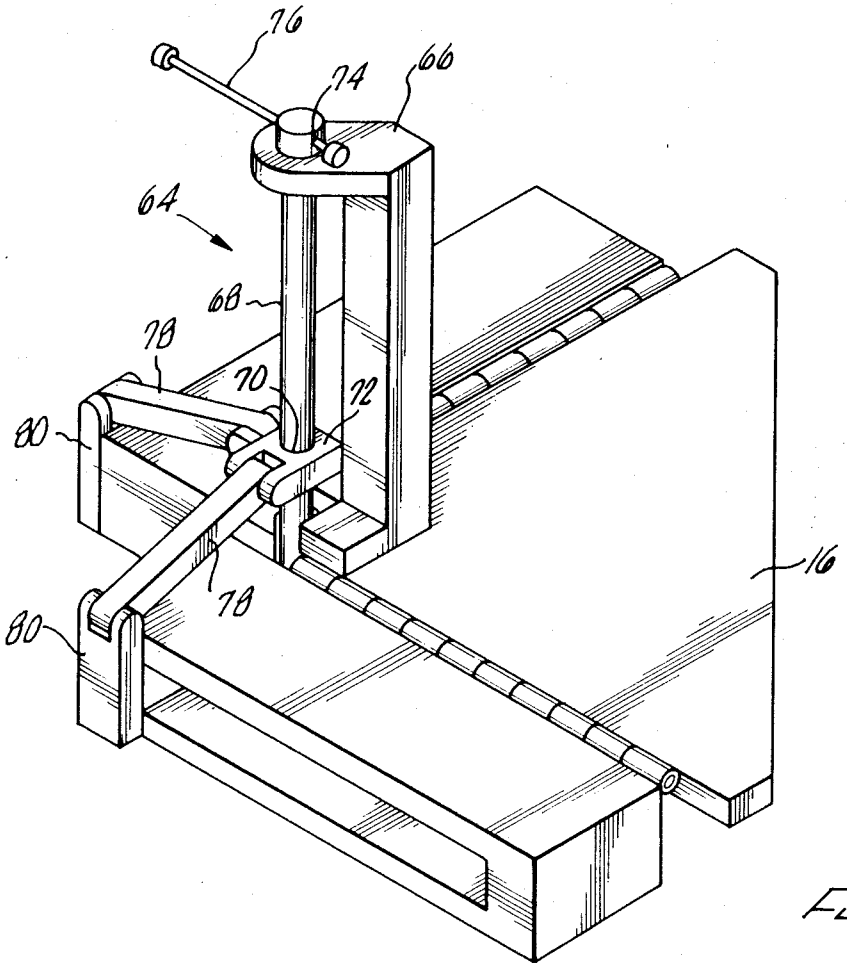
FIG. 3 is a perspective view of a third embodiment of the present invention.

FIG. 3 illustrates a third embodiment of the present invention in which the legs 14 of the L-shaped frame 10 can be tilted at an angle to the plane containing the upper base plate 16 via an angle adjusting means 64. More particularly, the angle adjusting means 64 comprise an adjusting bracket 66, the base of which is secured to the base plate 16 by bolts or welds or other means well known in the art (not shown). The adjusting bracket 66 extends outwardly from and perpendicular to the base plate 16, and the outer end of the adjusting bracket 66 contains a hole (not shown) through which passes a threaded rod 68 which is also oriented perpendicular to the base plate 16. The threaded rod 68 passes through a threaded hole 70 located in a tilting bracket 72, and extends toward the base plate 16. One end of the threaded rod 68 rests in an indentation (not shown) in the lower of the base plates 16 (not shown). The threaded rod 68 is held in place in the adjusting bracket 66 via spring clips, cotter pins, or other means well known in the art (not shown). The end of the threaded rod 68 extending through the hole in the outermost end of the adjusting bracket 66 is enlarged, and contains a hole 74 through which a handle rod 76 is inserted. The tilting bracket 72 is pivotably connected to the ends of two tilting arms 78 via pins (not shown). The other ends of the tilting arms 78 are pivotably connected via pins (not shown) to brackets 80 which are securely fastened to the ends of the legs 14 located nearest the corner of the L-shaped frame 10. Viewed from the top, the tilting arms 78 are oriented at right angles to each other in their respective connections to the tilting bracket 70. Legs 14 are pivotably connected to base plate 16 via hinges (not shown) which are well known in the art.

Rotation of the threaded rod 68 causes movement of the tilting bracket 72 along the length of the adjusting bracket 66, causing the tilting arms 78 to exert a pulling or pushing force on the brackets 80, resulting in an upward or downward tilting action of the legs 14 in relation to the base plate 16. Since each leg 14 contains the clamping means 12 of the preferred embodiment (not shown in FIG. 3), this adjustability allows more flexibility for the woodworker in mating pieces of wood with complex-angled ends.

FIGS. 4 and 5 illustrate a fourth embodiment of the present invention which combines the adjustability advantages of the first, second, and third embodiments described above. A small L-shaped frame, generally designated 82, comprises the legs 14 described in the previously discussed embodiments and hinged legs 84. The legs 14 are longitudinally pivotably connected to the hinged legs 84. The outer ends of the hinged legs 84 are pivotably connected to the outer ends of a hinged two-legged bracket 86, which generally consists of the upper half of the bracket 56 of the second embodiment.

An adjusting bracket 88, identical to the adjusting bracket 66 of the third embodiment, is secured to one of the two hinged legs 84 such that the axis of a threaded rod 90, which is supported by an adjusting bracket 88 in a manner described above for the third embodiment, is aligned with a pivot 92 of the small L-shaped frame 82, regardless of the angle between the legs 14. Between the ends of the adjusting bracket 88, the threaded rod 90 also passes serially down through a locknut 94, a non-threaded hole 92 located in an upper tilting bracket 96, and through a threaded hole (not shown) located in a lower tilting bracket 98.

The tilting brackets 96 and 98 perform the same function as the single tilting bracket 72 of the third embodiment, and are held in close contact with each other by a locknut 94. The locknut 94 can be tightened in order to force the tilting bracket 96, which freely and slidably moves along the threaded rod 90, against the tilting bracket 98, whose position along adjusting bracket 88 is determined by rotation of the threaded rod 88 in a manner as described above for the third embodiment. Thus, the fourth embodiment provides the multiple degrees of freedom of movement for the clamping means 12 as described in the first, second, and third embodiments individually described above, resulting in maximum flexibility for the woodworker as he joins complex-angled ends of wood pieces.

Thus, a corner clamp assembly is disclosed which utilizes several degrees of adjustability for joining complex angled ends of wood. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A corner clamp assembly comprising:

including a first and a second frame member, a first end of each of said frame members being joined to each other by a first pivotal connection, first and second bracket members, each of said bracket members having first and second ends, the first end of each of said bracket members being joined to each other by a second pivotal connection, the second end of said first frame member and the second end of said second bracket being joined to each other by a third pivotal connection, the second end of said second frame member and the second end of said second bracket being joined to each other by a fourth pivotal connection, such that a first angle of said L-shaped frame in a first plane can be varied and fixed by securing means, associated with said first through fourth pivotal connections, first and second legs, said first leg pivotally mounted onto said first frame member creating a degree of freedom in a second plane orthogonal to said first plane and said second leg pivotally mounted onto said second frame member creating a degree of freedom in a third plane orthogonal to said first plane, first and second clamping means, said first clamping means mounted on and extending substantially perpendicular to said first leg and said second clamping means mounted on and extending substantially perpendicular to said second leg, both of said first and second said clamping means being slidably movable along the length of the one of said legs to which it is mounted by a first adjusting means, said first and second clamping means having a clamping force which can be varied by a second adjusting means, pivoting means, connected to one of said frame members and to said first and second legs, for pivoting and fixing said first and second legs at a second angle to said first plane in said second and third planes respectively, said second angle controlled by a third adjusting means.

2. The invention of claim 1 wherein said clamping means comprises first and second clamping jaw members, said first jaw member extending outwardly from said leg of said L-shaped frame, said second jaw member slidably movable along a portion of said first jaw member said clamping force being dependent on the relative distance between said first and second jaw members.

3. The invention of claim 2 wherein said first adjusting means comprises a threaded rod passing through both a longitudinal slot in said leg of said L-shaped frame and through a threaded hole in a portion of the base of said first jaw member located within said slot, wherein rotation of said threaded rod causes said base of said first jaw member to be slidably moved along the length of said leg of said L-shaped frame.

4. The invention of claim 2 wherein said second adjusting means comprises a threaded rod passing through both a longitudinal slot in said outwardly extending portion of said first jaw member and through a base of said second jaw member located within said slot, wherein rotation of said threaded rod causes said base of said second jaw member to be slidably moved along the length of said outwardly extending portion of said first jaw member.

5. The invention of claim 1 wherein said securing means comprises bolts and nuts located at each of said pivotable connections.

6. The invention of claim 1 wherein said third adjusting means comprises a first support extending outwardly from one of said frame members, said first support containing a threaded rod extending outwardly from said one of said frame members, said threaded rod passing through a threaded hole in a second support pivotably connected to a first and a second connecting arm, said first connecting arm pivotally connected to a third support connected to said first leg, said second connecting arm pivotally connected to a fourth support connected to said second leg, wherein rotation of said threaded rod moves said second support, said connecting arms, and said third and fourth supports causing said first and second legs and thereby said first and second clamping means to be tilted at said second angle.

* * * * *